US006647937B2

(12) United States Patent
Nishimoto

(10) Patent No.: US 6,647,937 B2
(45) Date of Patent: Nov. 18, 2003

(54) GLOW PLUG ENERGIZATION CONTROLLING DEVICE

(75) Inventor: Michiaki Nishimoto, Fujisawa (JP)

(73) Assignee: Isuzu Motor Limited, Tokyo (JP)

( * ) Notice: Subject to any disclaimer, the term of this patent is extended or adjusted under 35 U.S.C. 154(b) by 0 days.

(21) Appl. No.: 10/177,244

(22) Filed: Jun. 24, 2002

(65) Prior Publication Data

US 2003/0010306 A1 Jan. 16, 2003

(30) Foreign Application Priority Data

Jun. 29, 2001 (JP) ..... 2001-198303

(51) Int. Cl.[7] ..... F02D 19/02
(52) U.S. Cl. ..... 123/145 A
(58) Field of Search ..... 123/406.53, 406.54, 123/406.5, 406.55, 605, 608, 618, 623, 625, 145 R, 145 A, 169 R, 143 B, 142.5 E, 142.5 R

(56) References Cited

U.S. PATENT DOCUMENTS 4,106,465 A * 8/1978 Bernhardt et al. ..... 123/179.21
4,318,374 A * 3/1982 Yasuhara ..... 123/179.6
4,478,181 A * 10/1984 Kikuchi et al. ..... 123/145 A
4,594,975 A * 6/1986 Shigenobu ..... 123/179.21
4,635,594 A * 1/1987 Ichikawa et al. ..... 123/179.6
4,821,690 A * 4/1989 Masaki ..... 123/179.21
4,939,347 A * 7/1990 Masaka et al. ..... 219/492
5,050,545 A * 9/1991 Shirata et al. ..... 123/179.21
5,469,819 A * 11/1995 Berger et al. ..... 123/179.6
5,724,932 A * 3/1998 Antone ..... 123/145 A
6,148,258 A * 11/2000 Boisvert et al. ..... 701/99

* cited by examiner

*Primary Examiner*—Hieu T. Vo
*Assistant Examiner*—Hai H. Huynh
(74) *Attorney, Agent, or Firm*—Rabin & Berdo, PC

(57) ABSTRACT

Glow plugs are connected in parallel. At the time of starting, a battery voltage is applied thereto and the glow plugs are heated. At the time of driving, on the basis of a detection signal from an engine speed sensor or an exhaust temperature sensor, it is judged by a controller whether or not the engine is in a poor combustion state. When it is judged that the engine is in a poor combustion state, neutral point N voltage (about half of the battery voltage) of an alternator is applied to the glow plug, and temperature of a combustion chamber is raised. Because there is no need to series/parallel switch-connect the glow plug, the circuit structure is simple.

2 Claims, 4 Drawing Sheets

| | B | R1 | R2 | C | ACC |
|---|---|---|---|---|---|
| preheating | ○ | ○ | | | |
| OFF | ○ | | | | |
| ON | ○ | | | | ○ |
| starting | ○ | | ○ | ○ | ○ |

GLOW PLUG ENERGIZATION CONTROLLING DEVICE

FIELD OF THE INVENTION

The present invention relates to a glow plug energization controlling device which controls energization of a glow plug used for a preheating apparatus of a diesel engine, not only at the time of starting but also at the time of driving.

BACKGROUND OF THE INVENTION

Diesel engines are widely used not only for vehicles but also for ships, and when used for ships, they are commonly called marine engines.

In order to make starting of such a diesel engine easy, various types of preheating apparatuses have been invented and have been provided for practical use. A preheating apparatus using a glow plug is the most general one.

This preheating apparatus inserts a glow plug in a combustion chamber of a diesel engine, and energizes the glow plug at the time of starting at which time fuel is hard to burn. If the glow plug is heated red hot by energization, the fuel injected by cranking of a starter is heated by the glow plug and becomes easy to burn, and starting is easily carried out.

Control of energization of the glow plug is carried out in relation to the operation of a key switch at the time of starting, and when starting is completed, usually, energization of the glow plug is stopped. However, even if starting is completed, the fuel is not necessarily always easy to burn. If the intake air temperature is low because the ambient temperature is low, or if the temperature of the engine hardly increases while driving after starting, the combustion state does not improve, and a rise of engine speed does not quickly occur. Further, the fuel which cannot be burned is exhausted as blue-white smoke, and that fuel mist adheres to and accumulates at an exhaust pipe.

For example, in a case where a diesel engine with a turbo-supercharger is used in a ship and the compression ratio is set to be small or the like, it frequently occurs that the combustion state worsens at the time of driving. If an attempt is made to output high power by such an engine, it is necessary to carry out high-supercharging, and therefore, the compression ratio must be small. However, in an engine having a small compression ratio, even if the temperature of the engine rises, the temperature of a combustion chamber does not rise much at the time of low-speed/low-load driving, and blue-white smoke, fuel mist, and an offensive smell are generated.

In the case of a ship or the like, if blue-white smoke is exhausted or a peculiar offensive smell is emitted, the crew, may become ill, and the fuel mist contaminates the ocean.

Note that the time of low-speed/low-load driving is, in other words, a time when extremely low-speed sailing is carried out due to idle driving.

Such a state arises, for example, when a fishing vessel sails at an extremely low-speed for operation or the like after reaching a desired water area or the like. If the operating time is long, idle driving is carried out for a long time. In a ship, unlike a vehicle, there are many cases in which cooling of an engine is carried out by a heat exchanger or directly by sea water. Therefore, the degree of lowering of the temperature of the combustion chamber is large, and the combustion state is worse than in the case of a vehicle.

Further, at the time of idle driving with no load (at the time of berthing), the combustion state deteriorates.

Due to this, of course, preheating of a diesel engine is carried out so as to raise the temperature and to easily carry out starting in as short time as possible at the time of starting. While driving after starting, it is desirable that the temperature is maintained at a temperature at which combustion is satisfactorily carried out.

Here, a structure has been proposed in which, initially, glow plugs are connected in parallel and are heated rapidly by heavy electric current being made to flow at the battery voltage, and then, after switching to a series connection, the same voltage is applied and light electric current for temperature maintenance is made to flow.

FIG. 2 is a diagram showing such a conventional glow plug energization controlling device (Japanese Patent Application Laid-Open No. 8-240173). In FIG. 2, the reference numeral 1 designates a battery, the reference numeral 3 designates a key switch, the reference numeral 4 designates a starter, the reference numerals 5A and 5B designate glow plugs, the reference numeral 10 designates a switching relay, the reference numeral 10-1 designates a movable contact, the reference numeral 10-2 designates a relay coil, the reference numerals D and E designate fixed contacts, the reference numeral 11 designates an engine speed sensor, the reference numeral 12 designates an exhaust temperature sensor, and the reference numeral 16 designates a glow display lamp.

The glow display lamp 16 is a lamp for displaying whether or not the glow plugs 5A, 5B are energized.

The switching relay 10 is a relay for making the glow plugs 5A, 5B, which are divided into two groups, parallel connection and series connection. When the relay coil 10-2 is de-energized, the movable contact 10-1 contacts the fixed contact D as shown by the solid line, and the glow plugs 5A, 5B are connected in parallel. When the relay coil 10-2 is energized, the movable contact 10-1 contacts the fixed contact E as shown by the dotted line, and the glow plugs 5A, 5B are connected in series. The glow plugs 5A, 5B are connected in parallel at the time of starting, and are connected in series at the time of energizing while driving.

Note that, in the case of the glow plug energization controlling device of FIG. 2 in a marine engine, as the glow plugs 5A, 5B, two-wire type glow plugs having 24V specifications are used for rapid heating. This glow plug is not a mass-produced product (standard product) for vehicles which are on the market generally, but is specially designed.

FIG. 5 is a view showing a two-wire type glow plug. The reference numeral 14 designates an engine body, the reference numeral 15 designates a two-wire type glow plug, the reference numeral 15-1 designates a conductive wire, the reference numeral 15-2 designates a metal case, the reference numeral 15-3 designates a heater coil, the reference numeral 15-4 designates an insulator, the reference numeral 15-5 designates a glow plug body, and the reference numeral 17-1 and 17-2 designate connectors.

In the two-wire type glow plug 15, both ends of the heater coil 15-3 are respectively connected to the connectors 17-1, 17-2 via the conductive wire 15-1.

Although the relay coil 10-2 of the switching relay 10 is energized by a signal from the controller 7, it is not energized at the time of starting. The control of energizing and de-energizing the relay coil 10-2 is carried out at the time of driving after starting. Energizing and de-energizing of the relay coil 10-2 are determined by a detection signal from the engine speed sensor 11 or the like, and the like.

The operations of the device of FIG. 2 are as follows.

(1) At the Time of Starting

FIG. 3 is a table of key switch connection at the time of starting. When the key switch 3 is at a "preheating" position, a B terminal connected to the battery 1 is connected to an $R_1$ terminal. Because the $R_1$ terminal is connected to the glow plugs 5A, 5B connected in parallel, battery voltage is applied thereto.

Next, the key switch 3 is rotated via the "OFF" position and the "ON" position to the "starting" position. There, the B terminal is connected to an $R_2$ terminal, a C terminal, and an ACC terminal. Because the $R_2$ terminal is connected, collectively with the $R_1$ terminal, to the glow plugs 5A, 5B connected in parallel, battery voltage is applied to the glow plugs 5A, 5B, respectively. At the time of starting, it is demanded that large electric current flows to the glow plugs and the glow plugs are immediately heated.

On the other hand, electric current flows from the C terminal to the starter 4, and cranking is carried out. At the same time, electric current flows from the C terminal to the controller 7, and notification is given that it is in the midst of starting. During the time that this notice is being received, the controller 7 maintains the switching relay 10 in a de-energized state. Namely, the glow plugs 5A, 5B are maintained in a parallel connection. Note that, at the time of the "ON" position and the "starting" position, operating power for the controller 7 is supplied from the ACC terminal.

(2) At the Time of Driving

When the key switch 3 is turned to the "ON" position which is at the time of driving, because the key switch 3 is no longer connected to the $R_1$ terminal, the $R_2$ terminal, and the B terminal, energization from these terminals to the glow plugs 5A, 5B is stopped. On the other hand, because electric current from the C terminal to the controller 7 is cut, the controller 7 stops maintaining the switching relay 10 in a de-energized state.

Thereafter, control, which compares the detection signal from the engine speed sensor 11 or the exhaust temperature sensor 12 with a set value described later and energizes or de-energizes the switching relay 10, is carried out. When the switching relay 10 is energized, the glow plugs 5A and 5B are connected in series, and the battery voltage is applied from the B terminal through the switching relay 10 to the series-connected glow plugs. The temperature of the combustion chamber is thereby raised, and the combustion state is improved.

Descriptions of set values relating to the exhaust temperature and the engine speed are as follows.

The exhaust temperature sensor 12 is used for indirectly detecting the temperature of the combustion chamber of the engine. A temperature T (for example: 300° C.), by which it can be recognized that the combustion state is satisfactory if the exhaust temperature is this temperature or more, has been previously determined by experiments or the like, and is set at the controller 7. The engine speed sensor 11 is used for judging whether the engine speed is in an idle driving state in which the combustion state is poor, or is in a usual driving state or sailing state.

When the exhaust temperature is higher than the aforementioned set temperature T at the time of driving, even if the engine speed is low, it is judged that the combustion state is good. This is because the temperature of the combustion chamber is high and the combustion state is good, if the exhaust temperature is higher than the set temperature T. A concrete example of such a case is a case where a ship is brought to a stop or is sailing at a very slow speed immediately after sailing at high speed. Although the engine speed is low, the exhaust temperature is higher than the set temperature T.

In a case where the exhaust temperature is lower than the set temperature T, the engine speed to be detected from the engine speed sensor 11 is considered. When the exhaust temperature is lower than the set temperature T and the engine speed is a value within a set range (which will be described in FIG. 4), the glow plugs are energized, and the temperature of the combustion chamber is raised. In this case, if the battery voltage is applied to the glow plugs, as they are, in parallel connection in the same way as at the time of starting, the life of the glow plugs is shortened.

The reason for this is that, because the glow plug is designed such that large electric current flows to the glow plug in order to reach a predetermined temperature in a short time at the time of starting, if, at the time of driving as well, the battery voltage is applied in the same way, wear progresses because there is a case of the energization time being long.

Thus, in order to prevent this, the glow plugs are switched to a series connection, and the applied voltage and electric current to the individual glow plugs are reduced.

FIG. 4 is a graph showing the relationship between the engine speed and the contact position of the switching relay 10. The glow plugs 5A, 5B are connected in parallel at the time when the contact position is D, and are connected in series at the time when the contact position is E. The engine speed range in which it is switched to a series connection is, so to speak, a poor combustion set range.

An engine speed $N_4$, (example: 1100 rpm), by which it is judged that the engine is in the usual driving state or sailing state if the engine speed is an engine speed not smaller than this value even when the exhaust temperature is lower than the set temperature T, is previously determined by experiments or the like, and is set at the controller 7.

Further, an engine speed $N_2$ (example: 400 rpm), which is a little lower than the idling engine speed, is set at the controller 7. Until the engine reaches the engine speed at the time of starting the engine, the glow plugs are connected in parallel, and starting of the engine is made easy. After the engine reaches this engine speed (example: 400 rpm), the engine starts easily by itself.

Further, when a marine gear is turned ON from an idling state (example: 500 rpm) in order to sail at a very low speed, because there are cases in which the engine speed decreases (example: 450 rpm) temporarily, the aforementioned $N_2$ is a value lower than the idling engine speed.

When the engine speed decreases from a high engine speed, an engine speed $N_3$ is set at the controller 7 such that it is switched to a series connection when the engine speed becomes the engine speed $N_3$ (example: 1000 rpm) which is a little lower than the aforementioned engine speed $N_4$. Further, that series connection switches to a parallel connection at the stage when the engine speed becomes an engine speed $N_1$ (example: 300 rpm) which is lower than the aforementioned engine speed $N_2$. The reason that hysteresis is kept in this way is to prevent chattering of the switching relay 10.

When the engine speed falls to the engine speed $N_1$ which is lower than the aforementioned engine speed $N_2$, even idling driving cannot be maintained, and there is a state in which the engine will stop soon. If energization to the glow plugs is not cut off, they will be continued to be energized even after the engine stops. Thus, by switching to a parallel connection at the engine speed $N_1$, energization is cut off.

There are following problems in the above-described conventional example.

The first problem is that a two-wire type glow plug is used as a glow plug in a marine engine. Because this is not a mass-produced product sold often on the market, and is designed specially, costs are high.

The second problem is that, because the way of connecting the glow plugs is switched at the time of starting and at the time of driving, the circuit structure becomes complex.

The object of the present invention is to solve such problems.

SUMMARY OF THE INVENTION

The subject of the invention is to adopt mass-produced products for a vehicle as glow plugs for a preheating apparatus of a diesel engine to make the costs be low, and to be unnecessary a series/parallel glow plugs switching structure.

In order to solve the aforesaid subjects, it is intended that the present invention provides a glow plug energization controlling device for a preheating apparatus of a diesel engine, characterized by comprising a plurality of glow plugs which are connected in parallel, and which are connected via a key switch to a battery and connected via a relay to a neutral point of an alternator to be driven by the diesel engine, and to which battery voltage is applied at a time of starting and voltage at the neutral point is applied at a time of turning the relay on while driving after starting, an engine speed sensor, an exhaust temperature sensor (or a cooling water temperature sensor) and a controller for turning the relay on when, after starting is completed, an exhaust temperature is lower than a set temperature and an engine speed is within a poor combustion set range.

BEST MODE FOR PRACTICING THE INVENTION

Hereinafter, embodiments of the present invention will be described on the basis of the figures.

Figure 1:
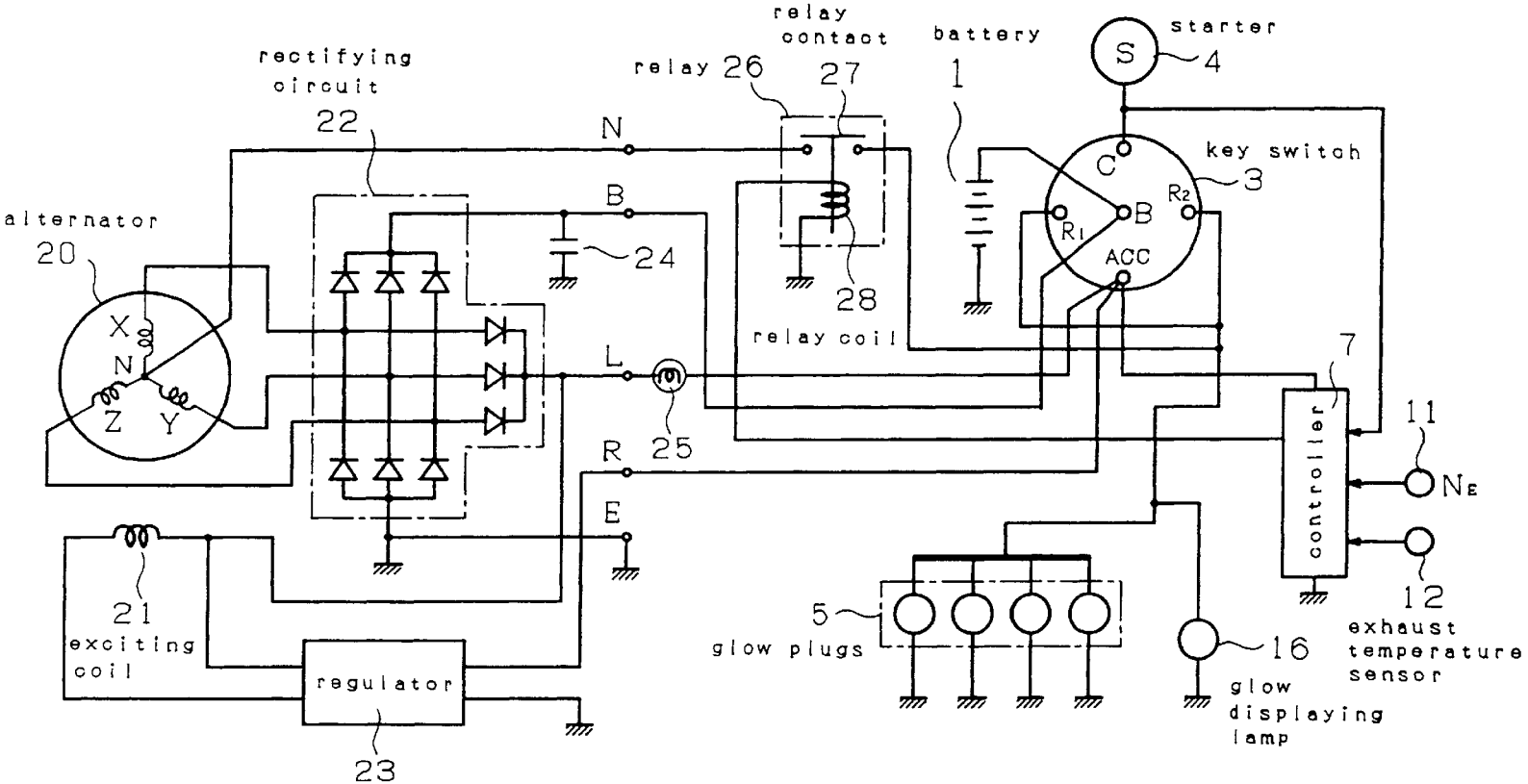
FIG. 1 is a diagram showing a glow plug energizing controlling device of the present invention.

FIG. 1 is a diagram showing a glow plug energizing controlling device of the present invention. The numerals correspond to the numerals of FIG. 2. The reference numeral 5 designates a glow plug, the reference numeral 12 designates an exhaust temperature sensor, the reference numeral 20 designates an alternator, the reference numeral 21 designates an exciting coil, the reference numeral 22 designates a rectifying circuit, the reference numeral 23 designates a regulator, the reference numeral 24 designates a capacitor, the reference numeral 25 designates a charge lamp, the reference numeral 26 designates a relay, the reference numeral 27 designates a relay contact, and the reference numeral 28 designates a relay coil.

Instead of the exhaust temperature sensor 12, a cooling water temperature sensor may be used.

Figures 2, 3:
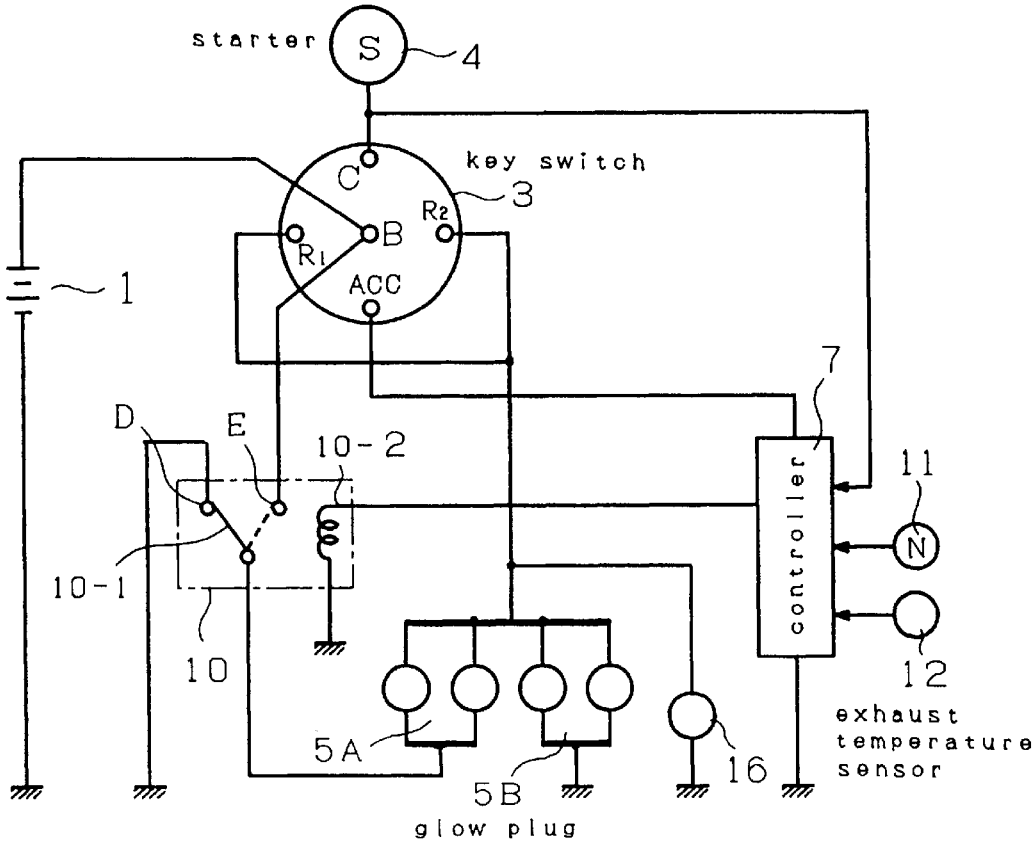
FIG. 2 Prior Art
FIG. 3 Prior Art
FIG. 2 is a diagram showing a conventional glow plug energizing controlling device.
FIG. 3 is a table showing operations and terminal connected states at a key switch.

Note that operations and terminals connection states at a key switch 3 are similar to those in FIG. 3, and because operations at the time of starting are also similar, description thereof will be omitted.

The alternator 20 is mounted on a vehicle, a ship or the like and is a generator driven by a diesel engine. The exciting coil 21, the rectifying circuit 22, the regulator 23, the capacitor 24 and the like are ancillary structural portions, and these are publicly known. The regulator 23 controls the generated voltage by controlling the excitation electric current to the exciting coil 21.

D.C. voltage from a B terminal of the alternator 20 is applied via a B terminal of the key switch 3 to a battery 1, and charging of the battery is carried out (although unillustrated, power is supplied to another electric load as well).

The charge lamp 25 is connected to between an Acc terminal and an L terminal of the key switch 3. Initially, electric current from the battery 1 flows to the Acc terminal→the charge lamp 25→the exciting coil 21, and the charge lamp 25 is turned on. However, the alternator generates, and when the voltage between the L terminal and the E terminal becomes the battery voltage (between the Acc terminal and the earth terminal) or more, the charge lamp 25 is turned off, and it is notified that charging has been carried out.

In the conventional example of FIG. 2, because the alternator 20 and the ancillary structural portions which are similar to those of FIG. 1 exist, these also can be drawn if so desired. However, even if these are drawn, they merely show the commonly-known point that the battery 1 is charged by the output of the alternator 20, and therefore, they are omitted from FIG. 2.

On the other hand, the reason why the alternator 20 and the like are also drawn in FIG. 1 will be made clear by the following description, and is to show the unique structure of the present invention apart from the commonly-known structure for charging a battery.

In the present invention, the first point different from the conventional example of FIG. 2 is in that standard products produced in large quantities as glow plugs for vehicles are adopted as the glow plug 5. Such mass-produced products are single-wire type glow plugs, and are low cost in comparison with the aforementioned two-wire type glow plug.

Figure 6:
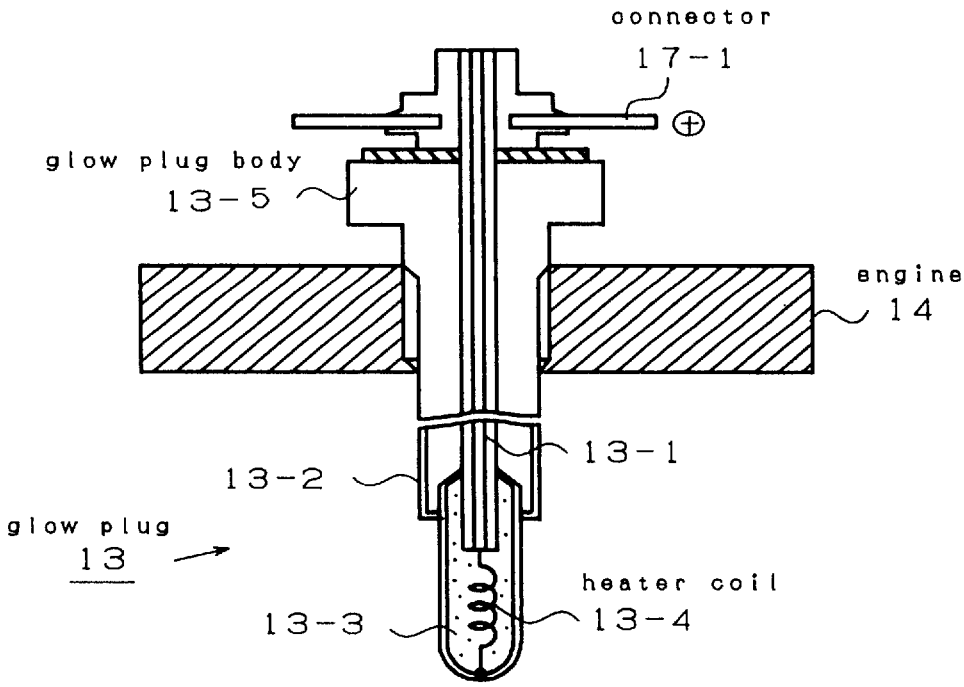
FIG. 6 is a view showing a single-wire type glow plug.

FIG. 6 is a diagram showing a single-wire type glow plug. In FIG. 6, the reference numeral 13 designates a single-wire type glow plug, the reference numeral 13-1 designates a conductive wire, the reference numeral 13-2 designates a metal case, the reference numeral 13-3 designates an insulator, the reference numeral 13-4 designates a heater coil, the reference numeral 13-5 designates a glow plug body, the reference numeral 14 designates a engine body, and the reference numeral 17-1 designates a connector.

In the single-wire type glow plug 13, one end of the heater coil 13-4 is connected to the metal case 13-2, and the other end is connected to the connector 17-1 via the conductive wire 13-1.

The second different point is in that voltage at the neutral point N of the alternator 20 is used as the voltage applied to the glow plug 5 at the time of driving. Note that the voltage at the neutral point N is half (12V) of the voltage taken out from between the terminals of the alternator 20 (the voltage used for charging the battery).

The relay 26 is a relay disposed on the wire between the neutral point N of the alternator 20 and a voltage applying terminal of the glow plug 5. Further, the relay coil 28 thereof is energized and de-energized by output of the controller 7, and the relay contact 27 is turned on and off. In the same way as in the case of FIG. 2, at the time of driving after starting the diesel engine, when it is judged on the basis of a detection signal from the engine speed sensor 11, the exhaust temperature sensor or the cooling water temperature sensor 12 that heating by the glow plug 5 is necessary, the controller 7 generates output energizing the relay coil 28 and turns on the relay contact 27. When it is not necessary, the controller 7 de-energizes the relay coil 28, and turns off the relay contact 27.

Figure 4:
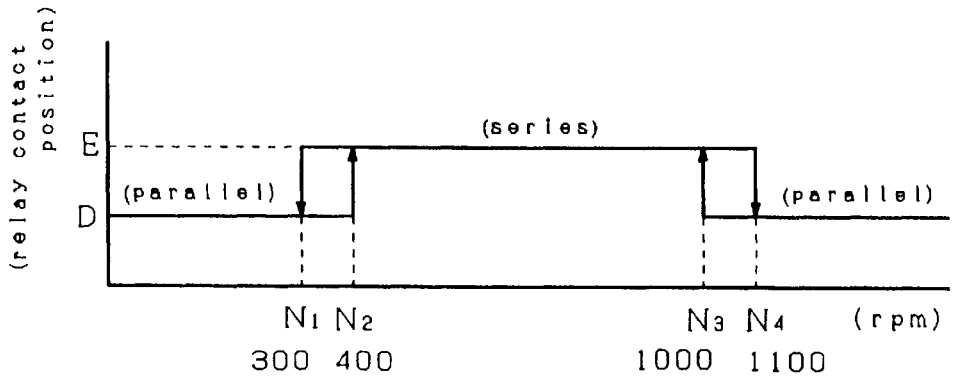
FIG. 4 Prior Art
FIG. 4 is a graph showing the relationship between engine speed and a relay contact position.
Figure 5:
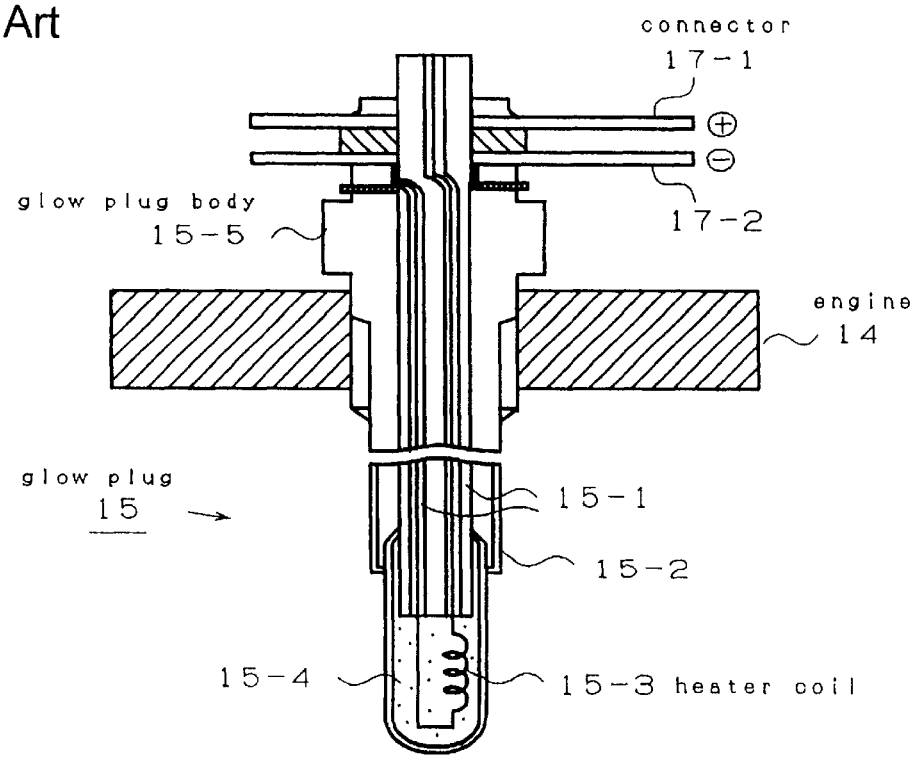
FIG. 5 Prior Art
FIG. 5 is a view showing a two-wire type glow plug.

Namely, whether or not the engine speed is within a poor combustion set range is judged in substantially the same way as in FIG. 4 when the exhaust temperature or the cooling water temperature is smaller than a set temperature. Accordingly, in the present invention, D of FIG. 4 corresponds to the relay contact 27 being off, and E corresponds to the relay contact 27 being on.

In this way, at the time of starting, battery voltage (24V), which is the rated voltage thereof, is applied to the glow plug 5 connected in parallel. When the relay contact 27 is turned on at the time of driving after starting, voltage taken out from the neutral point N of the alternator 20 is applied to the glow plug 5. Because the neutral point voltage is half (12V) of the battery voltage and is lower voltage than the rating for the glow plug 5, even if the voltage is applied for a long time, there is no fear that the life will be shortened.

In the present invention, there is no need to switch the connection of the glow plug 5 in series or in parallel, and the circuit structure is made simple by that much.

What is claimed are:

1. A glow plug energization controlling device for a preheating apparatus of a diesel engine, comprising:

a plurality of glow plugs which are connected in parallel, and which are connectable via a key switch to a battery, and connectable via a relay to a neutral point of an alternator to be driven by the diesel engine, and to which battery voltage is applied at a time of starting the diesel engine, and voltage at the neutral point is applied at a time of turning the relay on while driving after starting;

an engine speed sensor that detects an engine speed of the diesel engine;

an exhaust temperature sensor that detects an exhaust temperature from the diesel engine; and a controller for turning the relay on when, after starting is completed, the exhaust temperature is lower than a set temperature and the engine speed is within a poor combustion set range.

2. A glow plug energization controlling device for a preheating apparatus of a diesel engine, comprising:

a plurality of glow plugs which are connected in parallel, and which are connectable via a key switch to a battery, and connectable via a relay to a neutral point of an alternator to be driven by the diesel engine, and to which battery voltage is applied at a time of starting the diesel engine, and voltage at the neutral point is applied at a time of turning the relay on while driving after starting;

an engine speed sensor that detects an engine speed of the diesel engine;

a cooling water temperature sensor that detects a cooling water temperature; and a controller for turning the relay on when, after starting is completed, the cooling water temperature is lower than a set temperature and the engine speed is within a poor combustion set range.

* * * * *